United States Patent [19]

Banke et al.

[11] 4,438,053

[45] Mar. 20, 1984

[54] MAKING A FIBRILLATED SYNTHETIC-RESIN STRAND

[75] Inventors: Karl-Heinz Banke; Elisabeth Hering; Wilfried Löbel, all of Karl-Marx-Stadt; Dieter Pollack; Günter Wiedemann, both of Dresden; Ute Grell, Malchow; Ingo Schüler, Pirna-Copitz, all of German Democratic Rep.

[73] Assignee: Forschungsinstitut für Textiltechnologie, Karl-Marx-Stadt, German Democratic Rep.

[21] Appl. No.: 367,071

[22] Filed: Apr. 9, 1982

[30] Foreign Application Priority Data

Apr. 12, 1981 [DD] German Democratic Rep. ... 229183

[51] Int. Cl.[3] ..... B29D 27/00

[52] U.S. Cl. ..... 264/25; 264/41; 264/50; 264/126; 264/210.2; 264/288.8; 264/DIG. 8; 264/DIG. 47; 425/4 C; 425/174.4; 425/371

[58] Field of Search ..... 264/25, 22, DIG. 47, 264/126, 154, 41, 50, 210.2, 288.8, DIG. 8; 425/4 C, 174.4, 371

[56] References Cited

U.S. PATENT DOCUMENTS

| | | | |
|---|---|---|---|
| 3,022,542 | 2/1962 | Davis | 264/126 X |
| 3,048,537 | 8/1962 | Pall et al. | 264/126 X |
| 3,123,654 | 3/1964 | Malischewski | 264/126 |
| 3,192,294 | 6/1965 | Streed et al. | 264/126 X |
| 3,242,035 | 3/1966 | White | 264/DIG. 47 |
| 3,819,769 | 6/1974 | Pirot | 260/897 A |
| 3,882,063 | 5/1975 | Gouw | 264/DIG. 47 |
| 3,950,475 | 4/1976 | Dow et al. | 264/DIG. 47 |
| 4,123,490 | 10/1978 | Gibbon | 264/DIG. 47 |
| 4,315,880 | 2/1982 | Veenstra | 264/DIG. 47 |
| 4,370,141 | 1/1983 | Lee et al. | 264/25 X |

FOREIGN PATENT DOCUMENTS

| | | | |
|---|---|---|---|
| 2063440 | 3/1972 | Fed. Rep. of Germany . | |
| 2153503 | 5/1973 | Fed. Rep. of Germany | 264/154 |
| 1949170 | 7/1974 | Fed. Rep. of Germany . | |
| 128965 | 12/1977 | German Democratic Rep. . | |
| 84061 | 9/1979 | German Democratic Rep. . | |
| 137951 | 10/1979 | German Democratic Rep. . | |
| 48-4387 | 2/1973 | Japan | 264/154 |
| 1157695 | 7/1969 | United Kingdom | 264/DIG. 47 |

OTHER PUBLICATIONS

Meinhold, Henner, "Material Bearbeitung Durch Laser", (Material Machining by Laser) in *Elektronik Industrie,* vol. 2, No. 3, Mar. 20, 1971, pp. 32–35, (English Abstract). Note (The Institution of Electrical Engineers, Southgate House, Southgate, Stevenaga, Herta).

*Primary Examiner*—Philip E. Anderson
*Attorney, Agent, or Firm*—Karl F. Ross; Herbert Dubno

[57] ABSTRACT

A fibrillated strand is made by a method wherein first a mass of a powder of a high polymer is compressed into a substrate having a density smaller than that of the high polymer and having a multiplicity of gas-filled voids. Then an intense heat beam is played on the substrate to melt the high-polymer powder and simultaneously heat the gas of the voids to explosively enlarge same while the beam and substrate are relatively displaced so that the substrate is melted along a path. The substrate is cooled at least at the path after irradiation by the beam to form a porous strand extending along the path in the substrate. This strand is separated from the substrate and is then at least uniaxially stretched. The beam is a $CO_2$ $TEM_{00}$-mode laser beam and the method further comprises the step of focussing the laser beam on the substrate. The fused strand of the substrate is cooled so rapidly that it is normally not melted all the way through from top to bottom and from side to side. The rapid cooling of the strand prevents the strand from coalescing back into a smooth monofilament.

16 Claims, 4 Drawing Figures

MAKING A FIBRILLATED SYNTHETIC-RESIN STRAND

FIELD OF THE INVENTION

The present invention relates to the making of a fibrillated textile-like strand of a synthetic resin. More particularly this invention concerns such a strand made of a high-polymer resin.

BACKGROUND OF THE INVENTION

It is known to make fibers, fibrils, filaments, and openwork or reticulate fibrillated strands of high-polymer synthetic resins and mixtures thereof. The various organic and/or inorganic compounds are converted by casting, spinning, stretching, stretch-tearing, cutting, splicing, and joining into the desired form. East German Pat. No. 137,951 describes a method that forms a textile strand out of a mass of powder of a thermoplastic high-polymer resin. This mass is heated and treated to form the desired structure.

Fibrillated textiles, known and preferred over many synthetic-resin textiles for their nice look and hand, are constituted of fibrils which are morphologically overmolecular units that have diameters from 0.05 micron to 10 micron and lengths from 100 microns to several millimeters long. The fibrils normally extend parallel to the goods. This effect is achieved by the tendency of melt-spun polymer mixtures of polyethylene terephthalate, polyamides, polystyrene, and polyolefins to split, as discussed in U.S. Pat. No. 3,819,769. It is also known to position the fiber-forming polymer in a matrix and to dissolve out this matrix before, during, or after treating it. Such a method is inherently discontinuous, and consumes considerable quantities of valuable solvents.

More particularly, West German Pat. No. 2,040,802 describes a method of making compound filaments by imbedding polyethylene terephthalate fibrils in a polystyrene matrix. After dissolution of the matric fibers are obtained of a fineness of 0.1 dtex and a diameter of 4 micron. West German Pat. Nos. 1,949,170 and 2,063,440 describe mixtures of polyamides and polyethylene terephthalate including the matrix-fibril structure formed thereby. East German Pat. Nos. 128,965 and 84,061 describe methods of splicing together fibrillable foils.

A disadvantage of all of the known processes is that the fibrillability is only obtained using mixtures of normally incompatible polymers that are forced together under pressure. In addition it is necessary to use subsequent treatments, such as chemical dissolving or mechanical splicing, to complete the procedures.

OBJECTS OF THE INVENTION

It is therefore an object of the present invention to provide an improved method of and apparatus for making a fibrillated strand.

Another object is the provision of such a method of and apparatus for making a fibrillated strand which overcome the above-given disadvantages.

A further object is to make a fibrillated strand by a continuous and simple method having a minimum of process steps.

SUMMARY OF THE INVENTION

These objects are attained according to the instant invention in a method of making a fibrillated strand wherein first a mass of a powder of a high polymer is compressed into a substrate having a density smaller than that of the high polymer and having a multiplicity of gas-filled voids. Then an intense heat beam is played on the substrate to melt the high-polymer powder and simultaneously heat the gas of the voids to explosively enlarge same while the beam and substrate are relatively displaced so that the substrate is melted along a path. The substrate is cooled at least at the path immediately after irradiation by the beam to form a porous strand extending along the path in the substrate. This strand is separated from the substrate and is then at least uniaxially stretched. According to this invention the beam is a $CO_2$ $TEM_{oo}$-mode laser beam and the method further comprises the step of focussing the laser beam on the substrate.

The fused strip of the substrate is cooled so rapidly that it is normally not melted all the way through from top to bottom and from side to side, so that this fused strip is resting completely in a bed of unfused particles that utterly prevent it from sticking to the conveyor surface it is on. The rapid cooling of the strand is fairly critical, as it prevents it from coalescing back into a smooth monofilament. The intense heat of the beam melts the resin and causes the inclusions of air and water to extend explosively, thereby making the strand quite porous, which porosity is then frozen in. The voids, holes, and craters thus formed are elongated on subsequent longitudinal stretching of the strand to form the desired network of fibrils. During such stretching the longitudinal edges of the strand will curl or turn in, imparting a tubular shape to the strand, and the strand will, or course, be axially oriented.

The powder can be admixed with various additives, such as short inorganic fibers. It normally has a particle size of at most 200 micron, normally less than 100 micron.

It is also possible according to this invention to play a plurality of such beams on the substrate to form a plurality of respective strands that are cooled and subsequently separated from the substrate. These beams may be generated by fixed lasers, with the substrate moving relative to them. It is also possible to move the beams, either by moving the laser guns themselves or by reflecting their beams by means of a moving mirror or the like, or even to move the beams and the substrate both. The plural strands thus formed can be parallel or even cross each other When they cross it is possible to biaxially orient the web formed by the interlinked strands.

The powder is compressed according to this invention at a pressure of between $4 \cdot 10^3$ kPa and $10^5$ kPa, preferably between $7.28 \cdot 10^3$ kPa and $5.89 \cdot 10^4$ kPa.

The beam has, in accordance with this invention, a residence time $t_r$ on the substrate of between $10^{-1}$ sec and $10^{-3}$ sec. The beam strength is in turn adjusted depending on vertically how thick the fused strand is to be. The optimal beam energy level $E_{opt}$ is a function of the laser power $N_{Leff}$, the residence time $t_r$, and the diameter $d_f$ of the spot irradiated by the beam. The relationship is:

$$E_{opt} = 4 \cdot N_{Leff} t_r / d_f^2 \cdot \text{pi},$$

in which it is noted that $d_f^2 \cdot \text{pi}/4$ is the area of the irradiated spot.

According to another feature of this invention the substrate is cooled at least at the strand by flowing a coolant gas over it.. This gas is an inert gas. Thus the method further comprises the step of preventing oxidation of the molten high-polymer powder until same has cooled.

During stretching of the strand according to the invention it is heated. This can most simply be done by stretching it between pairs of heated rolls, with the upstream rolls cooler than the downstream ones. Normally the strand is stretched enough to pull some fibrils free at one end, thereby giving the strand a soft texture or hand.

If the powder carries some water, it is vaporized by the beam along the path. Thus with the system of this invention there is no need to maintain special low-humidity conditions. In fact the meticulous resin purity and moisture-free conditions that must be maintained in the systems of the prior art are unnecessary. A resin like polyester can be recirculated from the downstream end of the system to the upstream end, simply by breaking up the unfused part of the substrate and feeding it back upstream.

The process of the instant invention can also operate discontinuously. In this arrangement blocks or bodies of the substrate shaped like disks or cylinders and stable enough to be mounted in a support are rotated, reciprocated, or spun in front of an appropriate intense heat beam. In fact the strand can be peeled off such a body like a thread from a spool, thereby using the body most efficiently.

The system according to this invention produces a soft fibrillated strand suitable for use either alone or piled with other such strands to make a soft but strong yarn. Such a yarn will have the feel of a more expensive natural-fiber yarn, but is much cheaper, and normally more durable. It is also possible simply to tear up the strand made according to this invention to obtain fibrils usable in the manufacture of textiles.

DESCRIPTION OF THE DRAWING

The above and other features and advantages will become more readily apparent from the following description and examples, reference being made to the accompanying drawing in which.

SPECIFIC DESCRIPTION

Figure 1:
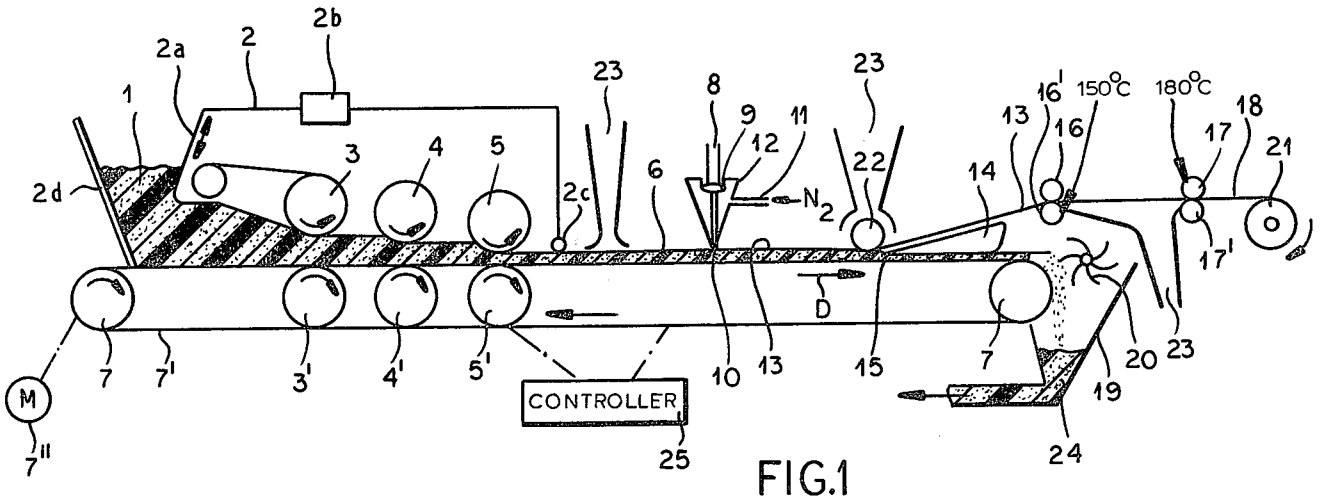
FIG. 1 is a largely schematic side view of an apparatus for carrying out the method of the instant invention.

As seen in FIG. 1 a high-polymer powder 1 is dosed by a feed arrangement 2 having an upstream feed plate 2*a*, a downstream feeler roller 2*c*, a hopper 2*d*, and a controller 2*b* onto a conveyor or transport surface formed by a belt 7' spanned over two rollers 7, one of which is connected to a motor 7'' operated in turn by a controller 25 linked to the controller 2*b*. Upstream relatively widely vertically spaced compacting rolls 3 and 3', middle less widely spaced rolls 4 and 4', and downstream closely spaced rolls 5 and 5' compress the powder 1 to form a substrate 6 that is slightly less dense than the powder itself, due to the inclusion of a multiplicity of microscopic air-filled voids.

A $CO_2$ laser 8 operating in the $TEM_{oo}$ mode is directed down through an adjustable focussing system 9 at a spot 10 on the substrate 6. This focusing system 9 and the laser beam downstream of it are surrounded by a nozzle 13 to which cool nitrogen is fed under pressure through an inlet pipe 11 so that the spot 10 is flooded with this relatively inert and cool gas.

Thus the powder of the substrate 6 will be fused along a path having a width equal to the dimension of the spot perpendicular to the transport direction D of the substrate and a depth determined by the power of the laser 8. This will form in the compacted powder substrate a fused thermoplastic strand 13. The tiny air-filled voids in this region will be explosively heated and at least some of them will burst, leaving the molten strand with a multiplicity of gas inclusions and surface craters that will give it an openwork structure, since the strand 13 is cooled before the craters and voids can flow together and close. In addition any moisture in the powder 1 will be vaporized, increasing this cratering. The melting will be limited by the cooling effect of the nitrogen, which simultaneously will prevent the hot resin from oxidizing.

Subsequently the thus formed openwork strand 13 is separated from the substrate 1 by a blade 14 having a cutting edge 15 positioned under a hold-down roller 22 above the upper stretch of the conveyor belt 7'. The strand passes through an upstream pair of heated rolls 16 and 16' and then between a downstream pair of heated rolls 17 and 17' that rotate faster than the rolls 16 and 16'. This produces a stretched strand 18 which is wound up on a take-up roller or spool 21. As the strand stretches its longitudinal edges curl in or under, thereby giving it an oval and tubular shape.

The substrate 6 that has been separated from the strand is meanwhile broken up by a wheel 10 to fall as powder 24 into a hopper 19. The powder from this hopper 19 as well as the powder picked up by vacuums 23 provided between the roller 2*c* and spot 10, over the roll 22, and underneath the stretching rolls 16–17' is returned to the supply hopper 2*d* at the upstream end of the arrangement. Any moisture picked up from the heating and cooling of the substrate 6 will merely add to the desirable vaporizable water inclusions. In addition there is no need to shield the arrangement from ambient moisture and the like.

Figure 2:
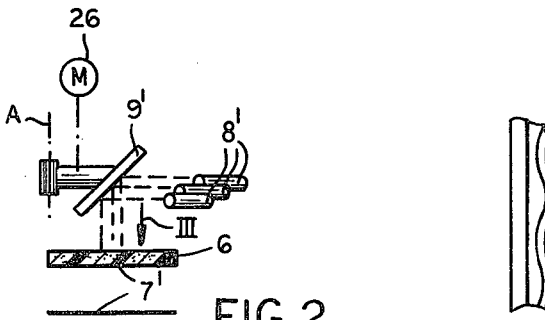
FIG. 2 is a side view of a detail of another apparatus according to this invention.
Figure 3:
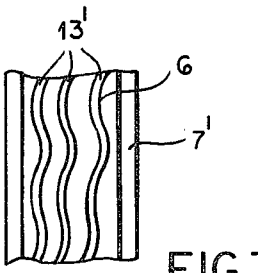
FIG. 3 is a view taken in the direction of arrow III of FIG. 2.

FIGS. 2 and 3 show an arrangement wherein three fixed lasers 8' are used which are directed upstream against the direction D parallel to but laterally offset from each other in a common horizontal plane at a mirror 9' that is arranged at 45° to their beams. This mirror 9' is oscillated back and forth about a vertical axis A by a motor 26 operated by the controller 25 to reflect the beams of the lasers 8' onto the substrate 6 in sine waves extending in the direction D and forming sinusoidal strands 13' as best shown by FIG. 3.

Figure 4:
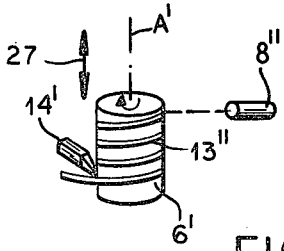
FIG. 4 is a side view of a detail of another apparatus according to this invention.

In FIG. 4 a cylindrical body 6' formed of a compacted mass of an appropriate synthetic-resin powder is simultaneously rotated about its axis A' and reciprocated slowly along it as indicated by arrows 27. A fixed laser gun 8'' is directed radially at the moving surface of the cylinder 6' to form a helical strand 13'' on it. A blade 14' moving with the body 6' strips this strand 13'' from the body 6' and feeds it to a stretcher such as shown in FIG. 1. As the diameter of the body 6' decreases, the blade 14' moves radially inwardly. This arrangement therefore works discontinuously, stopping each time the precompacted body 6' is exhausted.

EXAMPLE I

With the system of FIG. 1 the powder 1 is a polyester reduced by grinding to a particle size of less than 30 micron. The rollers 3–5′ exert a pressure of $5.89 \cdot 10^4$ kPa to give the substrate 6 a density of 1.3 g/cm$^3$, which is equal to 94% the density of high-polymer polyester being used. The substrate 6 thus formed has a vertical thickness or height of 1 mm and a horizontal width perpendicular to the direction D of 2 mm.

The substrate 6 is advanced by the belt 7′ at a speed of 49 m/sec. The laser 8 is a $CO_2$ $TEM_{oo}$-mode laser energized at 45 W and focussed by the adjustable focussing system 9 to form a round spot 10 having a diameter $d_f$ equal to 0.35 mm. The residence time $t_r$ of the laser beam on any given location on the substrate 6 therefore is $4.31 \cdot 10^{-4}$ sec, and the powder 1 will be melted to a depth of about 0.05 mm. The strand 13 is therefore a strip about 0.35 mm wide and 0.05 mm thick, some seven times wider than it is thick. The edge 15 of the blade 14 is positioned about 0.05 mm below the upper surface of the substrate 6, so that it just lifts off the strand 13 and the top portion of the compacted substrate 6.

The upstream stretch rolls 16 and 16′ are heated to a temperature of 150° C. and the downstream rolls 17 and 17′ to 180° C. The peripheral speed of the upstream rolls 16 and 16′ is 49 m/sec, the same as that of the substrate, and the peripheral speed of the rolls 17 and 17′ is about 200 m/sec, stretching the strand 13 by a factor of 4.1. This is enough to pull some of the fibrils that form loose at one end, creating a fuzzy effect that is extremely desirable in, for instance, a sweater knitted of a yarn formed by such strands 18.

This stretching causes, due to the biaxial gradient, the longitudinal edges of the strand 13 to turn in or roll so that the strand 18 is of oval section, U-shaped or tubular, with a thickness of about 0.018 mm and a width of about 0.141 mm, some eight times wider than it is thick. The strand 13 has a fineness of 7.6 tex. It is wound up at 200 m/sec on the spool 21.

EXAMPLE II

With the arrangement of FIGS. 2 and 3 the transport speed is approximately halved to 25 m/sec. The beams of the laser guns 8′ are deflected laterally through a trough-to-peak distance of 3 mm measured horizontally perpendicular to the direction D by deflection of the mirror 9′ through an appropriate arc about the axis A. The mirror 9′ is oscillated through this arc at a rate of 70 Hz. This moves the spot 10 at a rate of 75 m/sec.

Thus the system according to the present invention allows a fibrillated strand to be produced in one smooth and continuous operation. No messy solvents or complex stop-and-go procedures need be employed. Virtually none of the powder is wasted, and the method can easily be altered for different kinds of resins. The scrupulous care needed in the prior-art systems to keep the resin dry and pure is unnecessary, indeed a controlled level of contamination is a desirable thing, increasing the desired cratering and blistering effect that creates the voids that are eventually elongated to form the spaces between the fibrils. Otherwise the process is relatively easy to control to produce a high-quality product.

We claim:

1. A method of making a fibrillated strand, said method comprising the steps of:

compressing a mass of a powder of a high polymer of a predetermined density into a substrate having a density smaller than that of said high polymer and having a multiplicity of gas-filled voids;

playing a laser beam only on a spot on said substrate to melt the high-polymer at the spot and simultaneously heat the gas of said voids to explosively enlarge same;

relatively displacing said beam and said substrate so that same is melted along a path into a porous strand extending along said path in said substrate;

cooling said substrate at said path after irradiation by said beam to resolidify said porous strand;

separating the resolidified strand from said substrate; and at least uniaxially stretching the separated strand.

2. The method defined in claim 1, further comprising the step of focussing said laserbeam on said substrate.

3. The method defined in claim 2 wherein said beam is operated in the $TEM_{oo}$ mode.

4. The method defined in claim 1 wherein a plurality of such beams are played on said substrate to form a plurality of respective strands that are cooled and subsequently separated from said substrate.

5. The method defined in claim 1 wherein said powder is compressed at a pressure of between $4 \cdot 10^3$ kPa and $10^5$ kPa.

6. The method defined in claim 5 wherein said powder is compressed at a pressure of between $7.28 \cdot 10^3$ kPa and $5.89 \cdot 10^4$ kPa.

7. The method defined in claim 1 wherein said beam has a residence time on said substrate of between $10^{-1}$ sec and $10^{-3}$ sec.

8. The method defined in claim 1 wherein said substrate is cooled at least at said strand by flowing a coolant gas over it.

9. The method defined in claim 8 wherein said gas is an inert gas, whereby said method further comprises the step of preventing oxidation of the molten high-polymer powder until same has cooled.

10. The method defined in claim 1, further comprising the step of heating said strand while stretching same.

11. The method defined in claim 1 wherein said powder carries some water that is vaporized by said beam along said path.

12. The method defined in claim 1 wherein said strand is stretched sufficiently to pull at least some fibrils free at one end from said strand.

13. An apparatus for making a fibrillated strand, said apparatus comprising:

means for compressing a mass of a powder of a high polymer of a predetermined density into a substrate having a density smaller than that of said high polymer and having a multiplicity of gas-filled voids;

means for playing a laser beam only on a spot on said substrate to melt the high-polymer powder at the spot and simultaneously heat the gas of said voids to explosively enlarge same;

means for relatively displacing said beam and said substrate so that same is melted along a path into a porous strand strand extending along said path in said substrate;

means for cooling said substrate at said path after irradiation by said beam to resolidify said porous strand;

means for separating the resolidified strand from said substrate; and means for at least uniaxially stretching the separated strand.

14. The apparatus defined in claim 13 wherein the beam-playing means includes a $CO_2$ laser beam.

15. The apparatus defined in claim 14 wherein said beam-playing means includes means for focussing said laser beam.

16. The apparatus defined in claim 14 wherein said laser beam is fixed and said beam-playing means includes a movable reflector and means for displacing said reflector.

* * * * *